US009570040B2

(12) United States Patent
Yang et al.

(10) Patent No.: US 9,570,040 B2
(45) Date of Patent: Feb. 14, 2017

(54) DISPLAY DEVICE

(71) Applicant: AU Optronics Corporation, Hsin-Chu (TW)

(72) Inventors: Hsueh-Yen Yang, Hsin-Chu (TW); Hong-Shen Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 185 days.

(21) Appl. No.: 14/180,577

(22) Filed: Feb. 14, 2014

(65) Prior Publication Data

US 2015/0049124 A1 Feb. 19, 2015

(30) Foreign Application Priority Data

Aug. 14, 2013 (TW) ..... 102129157 A

(51) Int. Cl.
*G09G 5/02* (2006.01)

(52) U.S. Cl.
CPC ..... *G09G 5/022* (2013.01); *G09G 2300/0452* (2013.01); *G09G 2320/043* (2013.01); *G09G 2360/144* (2013.01)

(58) Field of Classification Search
CPC ..... G09G 2340/06; G06F 7/575
See application file for complete search history.

(56) References Cited

U.S. PATENT DOCUMENTS 7,042,521 B2 * 5/2006 Kim ..... H04N 1/6005 348/645
8,830,256 B2 * 9/2014 Botzas ..... G09G 5/02 345/589
2006/0214942 A1 9/2006 Tanase et al.
2009/0207182 A1 8/2009 Takada et al.

FOREIGN PATENT DOCUMENTS

TW I377540 6/2009

OTHER PUBLICATIONS

Wang et al., Trade-off between Luminance and Color in RGBW Displays for Mobile-phone Usage, SID Symposium Digest of Technical Papers, pp. 1142-1145, 2007.
Lai et al., A Modified Stripe-RGBW TFT-LCD with Image-Processing Engine for Mobile Phone Displays, IEEE Transactions on Consumer Electronics, vol. 53, No. 4, pp. 1628-1633, Nov. 2007.
Arnold, A. D. et al., Full-color AMOLED with RGBW pixel pattern. Journal of the Society for Information Display, pp. 525-535, 2005.

* cited by examiner

*Primary Examiner* — Antonio A Caschera
(74) *Attorney, Agent, or Firm* — WPAT, PC; Justin King

(57) ABSTRACT

A display device includes a color transformer and an image controller. The color transformer receives and transforms a three-color image into a four-color image. The four-color image includes a red image, a green image, a blue image, and a white image. The image controller calculates decrement offsets of the red image, the green image, and the blue image, and a compensation value of the white image. The image controller calculates gray level values of the red image, the green image, and the blue image when a value of the white image is zero. The image controller respectively calculates a red image control signal, a green image control signal, and a blue image control signal based on the gray level values and the decrement offsets, and the image controller calculates a white image control signal based on the gray level values and the compensation value of the white image.

17 Claims, 4 Drawing Sheets

DISPLAY DEVICE

RELATED APPLICATIONS

This application claims priority to Taiwan Application Serial Number 102129157, filed Aug. 14, 2013, which is herein incorporated by reference.

BACKGROUND

Technical Field

The present disclosure relates to an optical device. More particularly, the present disclosure relates to a display device.

Description of Related Art

With progress in technology, consumer expectations for high display quality of panels are increasing day by day. Hence, to enhance the display quality of panels, the size of a unit pixel needs to be decreased.

A unit pixel that has been decreased in size can only contain three pixels. In this case, a panel with an RGBW construction needs to reduce the red sub-pixels or blue sub-pixels, and accordingly, the unit pixel is arranged with an RGW or BGW construction. Such an arrangement will lead to a reduction in the operational life of the red sub-pixel or blue sub-pixel in the unit pixel.

In view of the foregoing, existing products have problems and disadvantages associated therewith that await further improvement. However, those skilled in the art have been unable to find a solution to such problems and disadvantages.

SUMMARY

The following presents a simplified summary of the disclosure in order to provide a basic understanding to the reader. This summary is not an extensive overview of the disclosure and it does not identify key/critical elements of the present disclosure or delineate the scope of the present disclosure.

One aspect of the present disclosure is directed to a display device. The display device includes a color transformer and an image controller. The color transformer is configured to receive and transform a three-color image into a four-color image, wherein the four-color image includes a red image, a green image, a blue image, and a white image. The image controller is configured to calculate a decrement offset of the red image, a decrement offset the green image, a decrement offset of the blue image, and a compensation value of the white image. The image controller is configured to calculate a gray level value of the red image, a gray level value of the green image, and a gray level value of the blue image when a value of the white image is zero, the image controller is configured to respectively calculate a red image control signal, a green image control signal, and a blue image control signal based on the gray level values and the decrement offsets, and the image controller is configured to calculate a white image control signal based on the gray level values and the compensation value of the white image, wherein one of the three-color image is zero and a signal value of the white image control signal is not zero.

Another aspect of the present disclosure is directed to a control method of a displaying image of a display device. The control method includes:

receiving and transforming a three-color image into a four-color image, wherein the four-color image includes a red image, a green image, a blue image and a white image;

calculating a decrement offset of the red image, a decrement offset of the green image, a decrement offset of blue image and a compensation value of the white image;

when a value of the white image is zero, calculating a gray level value of the red image, a gray level value of the green image, and a gray level value of the blue image;

calculating a red image control signal, a green image control signal and a blue image control signal according to the gray level values and the decrement offsets;

calculating a white image control signal according to the gray level values and the compensation value of the white image, wherein one of the three-color image is zero and a signal value of the white image control signal is not zero; and controlling the displayed image of the display device according to the red image control signal, the green image control signal, the blue image control signal, and the white image control signal.

Still another aspect of the present disclosure is directed to a display device. The display device includes a first color pixel, a second color pixel, a third color pixel, a fourth color pixel, and a data processing unit. The data processing unit is configured to receive a first input signal, a second input signal and a third input signal, and respectively provide a first output signal, a second output signal, a third output signal and a fourth output signal to the first color pixel, the second color pixel, the third color pixel and the fourth color pixel for displaying images, wherein a signal value of the first input signal is zero and a signal value of the fourth output signal is not zero.

These and other features, aspects, and advantages of the present disclosure, as well as the technical means and embodiments employed by the present disclosure, will become better understood with reference to the following description in connection with the accompanying drawings and appended claims.

BRIEF DESCRIPTION OF THE DRAWINGS

The invention can be more fully understood by reading the following detailed description of the embodiment, with reference made to the accompanying drawings as follows.

Figure 1:
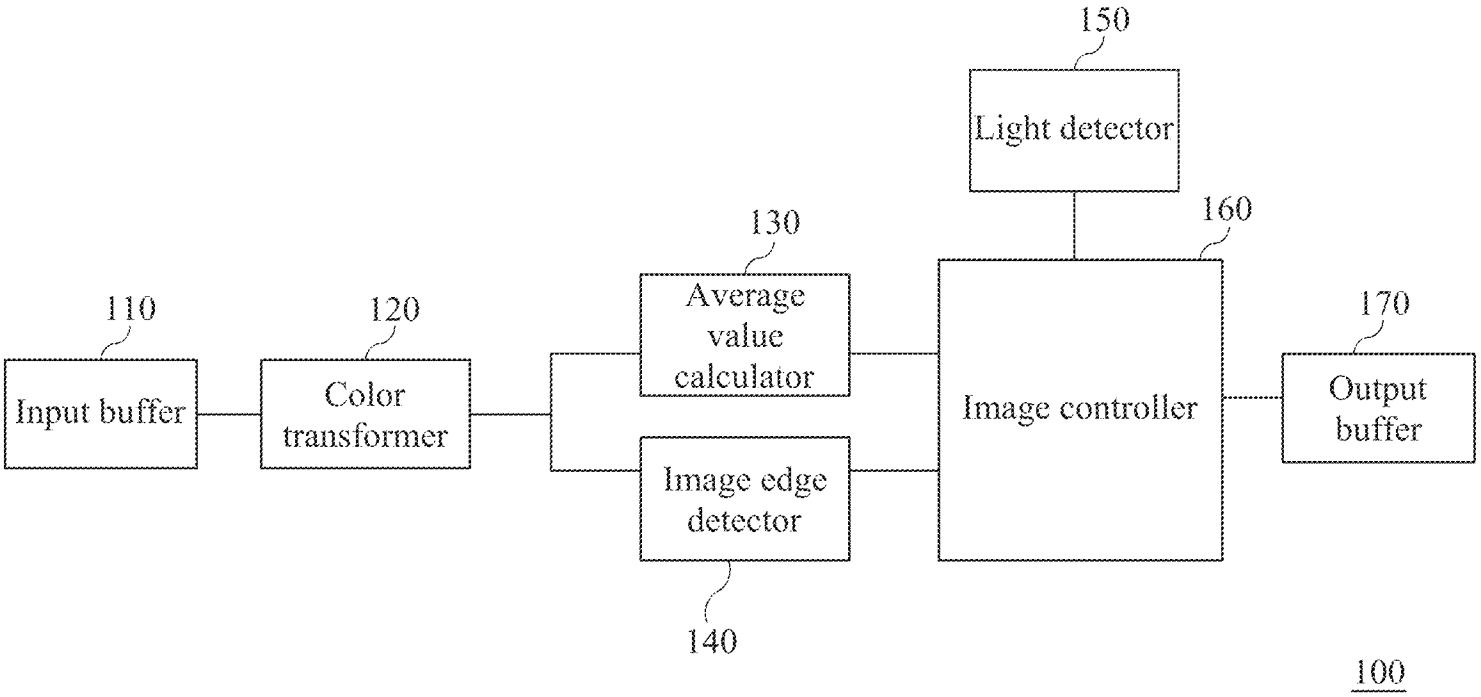
FIG. 1 is a circuit block diagram of a display device according to embodiments of the present disclosure.

In accordance with common practice, the various described features/elements are not drawn to scale but instead are drawn to best illustrate specific features/elements relevant to the present disclosure. Also, wherever possible, like or the same reference numerals are used in the drawings and the description to refer to the same or like parts.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include the singular Moreover, as used herein, the terms "couple" or "connect" refer to the physical or electrical contacts between two or more elements with each other, either directly or indirectly, or the mutual operation or interaction between two or more elements.

For solving the problems existing in the prior art, the present disclosure is directed to a display device which is illustrated in FIG. 1. As shown in FIG. 1, the display device 100 includes an input buffer 110, a color transformer 120, an average value calculator 130, an image edge detector 140, a light detector 150, an image controller 160 and an output buffer 170.

With respect to operation, the color transformer 120 is configured to receive a three-color image and transform the three-color image into a four-color image. For example, the color transformer 120 is configured to transform an RGB image into an RGBW image, wherein the RGBW image includes a red image R, a green image G, a blue image B, and a white (or transparent) image W.

When the four-color image is obtained, the image controller 160 is configured to calculate a decrement offset of the red image, a decrement offset of the green image, a decrement offset of the blue image and a compensation value of the white image. Subsequently, when a value of the white image is zero, the image controller 160 is configured to calculate a gray level value of the red image, a gray level value of the green image, and a gray level value of the blue image, to respectively calculate a red image control signal, a green image control signal and a blue image control signal according to the gray level values and the decrement offsets, and to calculate a white image control signal according to the gray level values and the compensation value of the white image. One of the three-color images is zero, but a signal value of the white image control signal is not zero. In addition, when another color frame is displayed, the signal values of two colors in the three-color image are zero. For example, the signal values of the red and green images are zero, the signal values of the red and blue image are zero, or the signal values of the blue and green image are zero. However, the signal value of the white image control signal is not zero. Thereafter, the image control signals are transmitted to a driving circuit via the output buffer 170 so as to control a plurality of pixels which are included by the display device.

As a result, since the compensation value of the white image can be used to compensate for the decrement offset of the red image, the decrement offset of the green image, and the decrement offset of the blue image, the operational life of a red sub-pixel and a blue sub-pixel of a unit pixel may be increased.

In one embodiment of the present disclosure, the average value calculator 130 of the display device 100 is configured to respectively calculate an average value of the red image, an average value of the green image and an average value of the blue image. These average values can be the average value of the whole frame of the display device, or the average value of some area in the frame. Subsequently, the average value calculator 130 is configured to transmit the average values to the image controller 160, and the image controller 160 respectively calculates the red image control signal, the green image control signal and the blue image control signal according to the gray level values, the decrement offsets and the average values, and the image controller 160 calculates the white image control signal according to the gray level values, the average values and the compensation value of the white image. Thereafter, the image control signals are transmitted to the driving circuit via the output buffer 170 for controlling a plurality of pixels which are included in the display device 100. Hence, the average value calculator 130 of the display device 100 can be used to calculate average values of any color, and the display device 100 can adjust images displayed by the pixels based on average values of any kind of color so as to prolong the operational life of the red sub-pixel and the blue sub-pixel of a unit pixel.

Specifically, the image controller 160 is configured to respectively calculate the red image control signal, the green image control signal, the blue image control signal and the white image control signal according to formulas as shown below:

$$\begin{cases} R_o = R_s - dR \times R_s/(2^n-1) \times R_{avg}/(2^n-1) \\ G_o = G_s - dG \times G_s/(2^n-1) \times G_{avg}/(2^n-1) \\ B_o = B_s - dB \times B_s/(2^n-1) \times B_{avg}/(2^n-1) \\ W_o = W_s + dW_r \times R_s/(2^n-1) \times R_{avg}/ \\ (2^n-1) + dW_g \times G_s/(2^n-1) \times G_{avg}/(2^n-1) + \\ dW_b \times B_s/(2^n-1) \times B_{avg}/(2^n-1) \end{cases}$$

Figure 2:
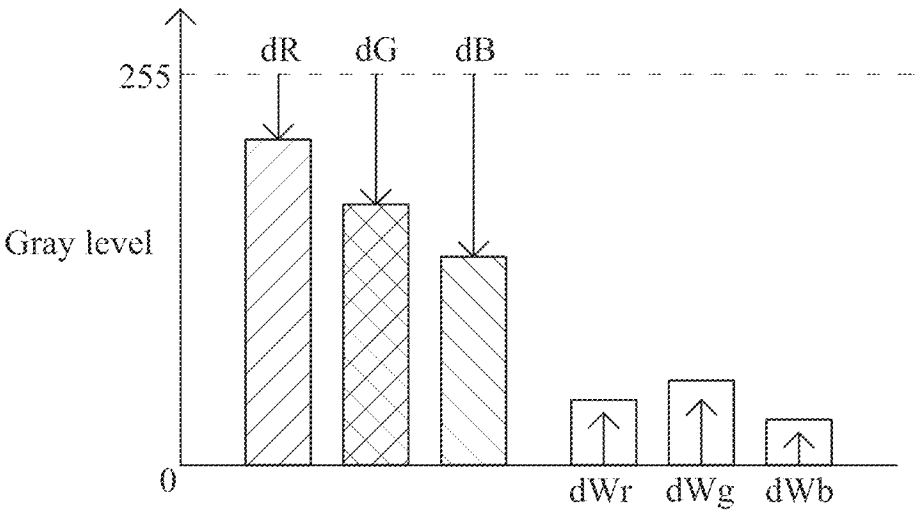
FIG. 2 is a schematic diagram of an image decrement offset and compensation value according to embodiments of the present disclosure.

As shown above, $R_o$, $G_o$, $B_o$, $W_o$ are the red image control signal, the green image control signal, the blue image control signal and the white image control signal respectively, and $R_s$, $G_s$, $B_s$, $W_s$ are the gray level value of the red image, the gray level value of the green image, the gray level value of the blue image and the gray level value of the white image respectively, wherein when $W_s$ is zero, $W_o$ is not zero. In addition, dR, dG, dB are the decrement offset of the red image, the decrement offset of the green image and the decrement offset of the blue image respectively (see FIG. 2), and $R_{avg}$, $G_{avg}$, $B_{avg}$ are the average value of the red image, the average value of the green image and the average value of the blue image respectively, wherein the compensation value of the white image includes a compensation value of the white image against the red image $dW_r$, a compensation value of the white image against the green image $dW_g$ and a compensation value of the white image against the blue image $dW_b$ (see FIG. 2), wherein n is a positive integer.

In another embodiment, the light detector 150 of the display device 100 is configured to detect an external environmental light source to generate and transmit a light detection signal to the image controller 160, and the image controller 160 is configured to respectively calculate the red image control signal, the green image control signal and the blue image control signal according to the gray level values, the decrement offsets and the light detection signal, and the image controller 160 is configured to calculate the white image control signal according to the gray level values, the light detection signal and the compensation value of the white image. Thereafter, the image control signals are transmitted to the driving circuit via the output buffer 170 for controlling a plurality of pixels which are included in the display device. Hence, the light detector 150 of the display device 100 can be used to detect the external environmental light source, and the display device 100 can adjust images displayed by the pixels based on the condition of the external environmental light source so as to prolong the operational life of a red sub-pixel and a blue sub-pixel of a unit pixel.

Specifically, the image controller 160 is configured to calculate the red image control signal, the green image control signal, the blue image control signal and the white image control signal according to formula as shown below:

$$\begin{cases} R_o = R_s - dR \times R_s/(2^n-1) \times E_v/(2^n-1) \\ G_o = G_s - dG \times G_s/(2^n-1) \times E_v/(2^n-1) \\ B_o = B_s - dB \times B_s/(2^n-1) \times E_v/(2^n-1) \\ W_o = W_s + dW_r \times R_s/(2^n-1) \times E_v/ \\ (2^n-1) + dW_g \times G_s/(2^n-1) \times E_v/(2^n-1) + \\ dW_b \times B_s/(2^n-1) \times E_v/(2^n-1) \end{cases}$$

As shown above, $R_o$, $G_o$, $B_o$, $W_o$ are the red image control signal, the green image control signal, the blue image control signal and the white image control signal respectively, and $R_s$, $G_s$, $B_s$, $W_s$ are the gray level value of the red image, the gray level value of the green image, the gray level value of the blue image and the gray level value of the white image respectively, wherein when $W_s$ is zero, $W_o$ is not zero. In addition, dR, dG, dB are the decrement offset of the red image, the decrement offset of the green image and the decrement offset of the blue image respectively (see FIG. 2), and Ev is the light detection signal, wherein the compensation value of the white image includes a compensation value of the white image against the red image $dW_r$, a compensation value of the white image against the green image $dW_g$ and a compensation value of the white image against the blue image $dW_b$ (see FIG. 2), wherein n is a positive integer.

In another embodiment, the image edge detector 140 of the display device 100 is configured to respectively detect an image edge of the red image, an image edge of the green image and an image edge of the blue image, and transmit the image edges to the image controller 160. The image controller 160 is configured to respectively calculate the red image control signal, the green image control signal, and the blue image control signal according to the gray level values, the decrement offsets, and the image edges, and the image controller 160 is further configured to calculate the white image control signal according to the gray level values, the image edges, and the compensation value of the white image. Thereafter, the image control signals are transmitted to the driving circuit via the output buffer 170 for controlling a plurality of pixels which are included in the display device 100. Hence, the image edge detector 140 of the display device 100 can be used to detect image edges of any colors, and the display device 100 can adjust images displayed by the pixels based on image edges of any kind of color so as to prolong the operational life of a red sub-pixel and a blue sub-pixel of a unit pixel.

Specifically, the image controller 160 is configured to calculate the red image control signal, the green image control signal, the blue image control signal, and the white image control signal according to the formulas as shown below:

$$\begin{cases} R_o = R_s - dR \times R_s/(2^n-1) \times R_{edge}(x, y)/(2^n-1) \\ G_o = G_s - dG \times G_s/(2^n-1) \times G_{edge}(x, y)/(2^n-1) \\ B_o = B_s - dB \times B_s/(2^n-1) \times B_{edge}(x, y)/(2^n-1) \\ W_o = W_s + dW_r \times R_s/(2^n-1) \times R_{edge}(x, y)/(2^n-1) + \\ dW_g \times G_s/(2^n-1) \times G_{edge}(x, y)/(2^n-1) + \\ dW_b \times B_s/(2^n-1) \times B_{edge}(x, y)/(2^n-1) \end{cases}$$

As shown above, $R_o$, $G_o$, $B_o$, $W_o$ are the red image control signal, the green image control signal, the blue image control signal and the white image control signal respectively, and $R_s$, $G_s$, $B_s$, $W_s$ are the gray level value of the red image, the gray level value of the green image, the gray level value of the blue image, and the gray level value of the white image respectively, wherein when Ws is zero, Wo is not zero. In addition, dR, dG, dB are the decrement offset of the red image, the decrement offset of the green image and the decrement offset of the blue image respectively (see FIG. 2), and $R_{edge}$, $G_{edge}$, $B_{edge}$ are the image edge of the red image, the image edge of the green image, and the image edge of the blue image respectively, wherein the compensation value of the white image includes a compensation value of the white image against the red image $dW_r$, a compensation value of the white image against the green image $dW_g$, and a compensation value of the white image against the blue image $dW_b$ (see FIG. 2), wherein n is a positive integer.

Figure 3:
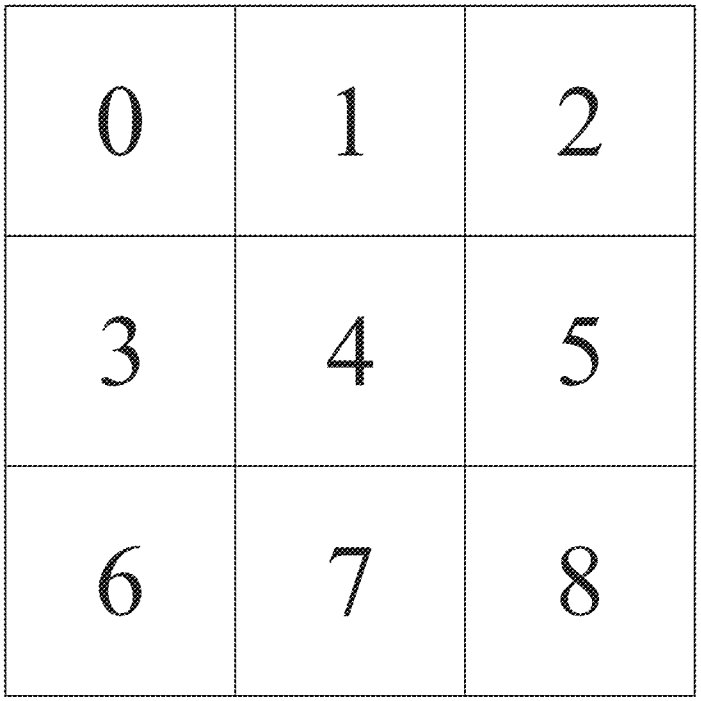
FIG. 3 is a schematic diagram used to describe a way of calculating an image edge variation value according to embodiments of the present disclosure.

To facilitate the understanding of producing the image edge variation value $R_{edge}$ of the red image, the image edge variation value $G_{edge}$ of the green image and the image edge variation value $B_{edge}$ of the blue image, reference is now made to FIG. 3, which is a schematic diagram used to describe a way of calculating an image edge variation value according to embodiments of the present disclosure. Using block 4 in which the red image is located as an example, the manner of calculating the image edge variation value $R_{edge}$ is as shown below:

$$Redge=(abs(SR[4]-SR[0])+abs(SR[4]-SR[1])+abs(SR[4]-SR[2])+abs(SR[4]-SR[3])+abs(SR[4]-SR[4])+abs(SR[4]-SR[5])+abs(SR[4]-SR[6])+abs(SR[4]-SR[7])+abs(SR[4]-SR[8]))/8$$

In the above, abs (A) indicates calculating the absolute value of A0, and SR[B] indicates calculating the gray level value of the red image input source in B area.

Figure 4:
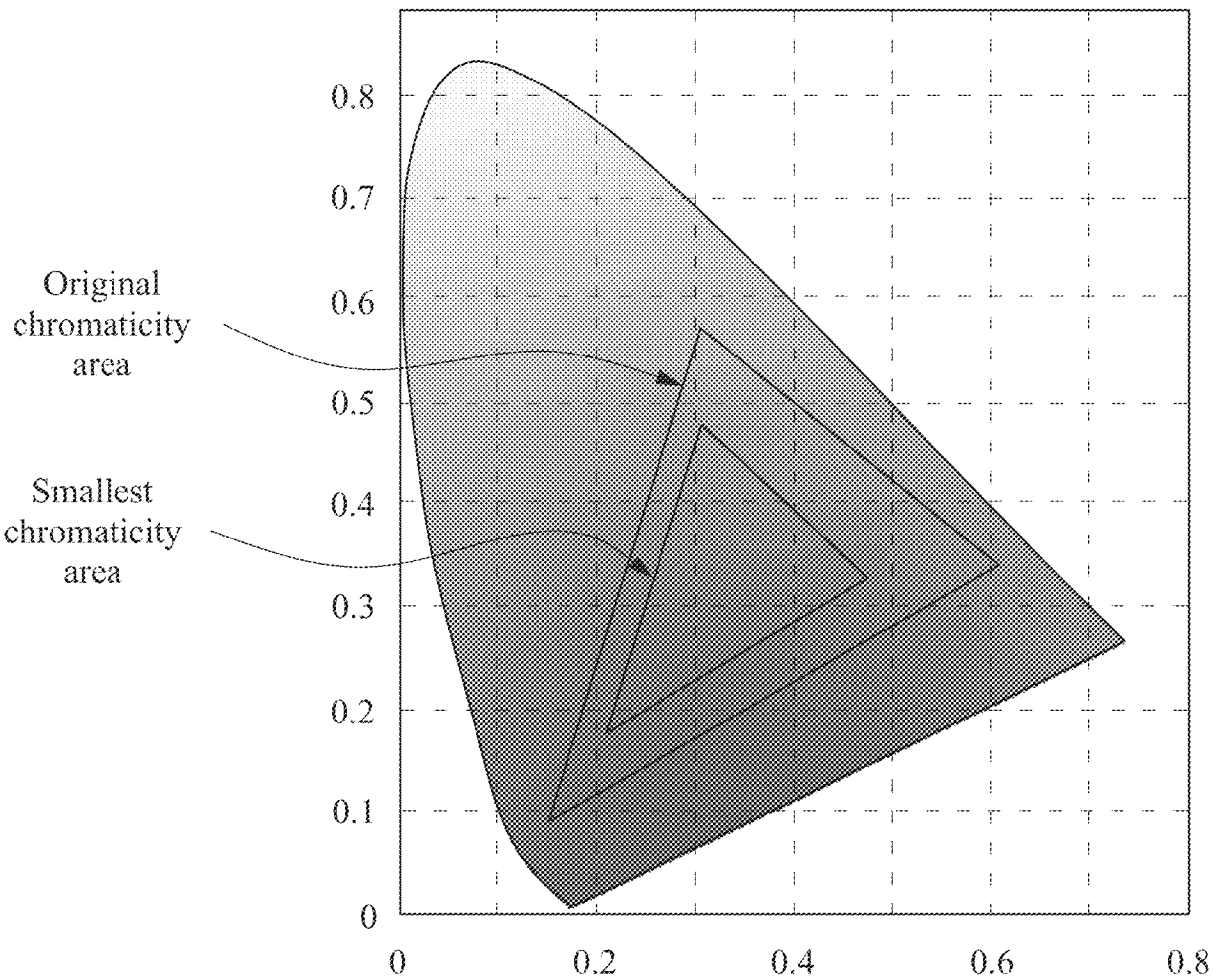
FIG. 4 is a schematic diagram of a chromaticity area according to embodiments of the present disclosure.

To describe the generation of the decrement offset and the compensation value, reference is now made to FIG. 4, which is a schematic diagram of a chromaticity area according to embodiments of the present disclosure. In an optional embodiment, the image controller 160 is configured to measure a smallest chromaticity area of the display device 100. The smallest chromaticity area is measured for every display device. "Smallest" chromaticity area refers to the smallest region of the chromaticity area which can be accepted by every display device. Generally, the smallest chromaticity area of every display device accounts for 60~80% or 70~90% of said chromaticity area. Preferably, the smallest chromaticity area of every display device accounts for 65%, 75% or 85% of said chromaticity area. Thereafter, the image controller 160 is configured to respectively calculate the decrement offset of the red image, the decrement offset of the green image, the decrement offset of the blue image, and the compensation value of the white image according to the smallest chromaticity area.

Another aspect of the present disclosure is to provide a control method of a displaying image of a display device. Hereinafter, reference is made to the display device 100 as illustrated in FIG. 1 for understanding said control method. The control method includes receiving and transforming a three-color image into a four-color image by the color transformer 120. For example, the color transformer 120 is configured to transform an RGB image into an RGBW image, wherein the RGBW image includes a red image R, a green image G, a blue image B, and a white image W. Subsequently, the control method includes calculating a decrement offset of the red image, a decrement offset of the green image, a decrement offset of blue image and a compensation value of the white image by the image controller 160.

In addition, when a value of the white image is zero, a gray level value of the red image, a gray level value of the green image, and a gray level value of the blue image are calculated by the image controller 160, and a red image control signal, a green image control signal, and a blue image control signal are calculated according to the gray level values and the decrement offsets by the image controller 160. Thereafter, the image controller 160 is configured to calculate a white image control signal according to the gray level values and the compensation value of the white image, wherein one of the three-color image is zero, but the signal value of the white image control signal is not zero. Furthermore, another color frame is displayed, and the signal values of two colors in the three-color image are zero. For example, the signal values of the red and green images are zero, the signal values of the red and blue image are zero, or the signal values of the blue and green image are zero. However, the signal value of the white image control signal is not zero. In addition, the displayed image of the display device 100 is controlled according to the red image control signal, the green image control signal, the blue image control signal, and the white image control signal.

As a result, since the compensation value of the white image can be used to compensate for the decrement offset of the red image, the decrement offset of the green image, and the decrement offset of the blue image so as to the operational life of a red sub-pixel and a blue sub-pixel of a unit pixel.

In one embodiment, the control method of the displaying image of the display device further includes calculating an average value of the red image, an average value of the green image, and an average value of the blue image by the average value calculator 130 of the display device 100. These average values can be the average value of the whole frame of the display device, or the average value of some area in the frame.

Subsequently, the red image control signal, the green image control signal, and the blue image control signal are respectively calculated by the image controller 160 according to the gray level values, the decrement offsets, and the average values. The white image control signal is calculated by the image controller 160 according to the gray level values, the average values, and the compensation value of the white image. Thereafter, the image control signals are transmitted to the driving circuit via the output buffer 170 for controlling a plurality of pixels which are included in the display device 100. In addition, the formula for calculating the red image control signal, the green image control signal, the blue image control signal, and the white image control signal by the image controller 160 has been described above; therefore, a description thereof is omitted herein for the sake of brevity.

In another embodiment, the control method of the displaying image of the display device further includes detecting an external environmental light source by the light detector 150 of the display device 100 to generate a light detection signal; then, respectively calculating the red image control signal, the green image control signal, and the blue image control signal according to the gray level values, the decrement offsets, and the light detection signal by the image controller 160; and calculating the white image control signal according to the gray level values, the light detection signal and the compensation value of the white image by the image controller 160.

Thereafter, the image control signals are transmitted to the driving circuit via the output buffer 170 for controlling a plurality of pixels which are included in the display device. Hence, the light detector 150 of the display device 100 can be used to detect the external environmental light source, and the display device 100 can adjust images displayed by the pixels based on the condition of the external environmental light source so as to prolong the operational life of a red sub-pixel and a blue sub-pixel of a unit pixel. In addition, the formula for calculating the red image control signal, the green image control signal, the blue image control signal, and the white image control signal by the image controller 160 has been described above; therefore, a description thereof is omitted herein for the sake of brevity.

In another embodiment, the control method of the displaying image of the display device further includes respectively detecting an image edge of the red image, an image edge of the green image and an image edge of the blue image by the image edge detector 140 of the display device 100. Subsequently, the control method of the displaying image of the display device further includes respectively calculating the red image control signal, the green image control signal, and the blue image control signal according to the gray level values, the decrement offsets, and the image edges by the image controller 160; and calculating the white image control signal according to the gray level values, the image edges, and the compensation value of the white image by the image controller 160.

Thereafter, the image control signals are transmitted to the driving circuit via the output buffer 170 for controlling a plurality of pixels which are included in the display device 100. In addition, the formula for calculating the red image control signal, the green image control signal, the blue image control signal, and the white image control signal by the image controller 160 has been described above; therefore, a description thereof is omitted herein for the sake of brevity.

In an optional embodiment, the control method of the displaying image of the display device further includes measuring the smallest chromaticity area of the display device 100 by the image controller 160. The smallest chromaticity area is measured for every display device. "Smallest" chromaticity area refers to the smallest region of the chromaticity area which can be accepted by every display device. Generally, the smallest chromaticity area of every display device accounts for 60~80% or 70~90% of said chromaticity area. Preferably, the smallest chromaticity area of every display device accounts for 65%, 75% or 85% of said chromaticity area. Thereafter, the image controller 160 is configured to respectively calculate the decrement offset of the red image, the decrement offset of the green image, the decrement offset of the blue image and the compensation value of the white image according to the smallest chromaticity area.

Still another aspect of the present disclosure is to provide a display device. The display device includes a first color pixel, a second color pixel, a third color pixel, a fourth color pixel, and a data processing unit. It is noted that the data processing unit can be an integrated unit of elements 110~170 as shown in FIG. 1, and the data processing unit can execute functions of the elements 110~170 simultaneously. With respect to operations, the data processing unit is configured to receive a first input signal, a second input signal and a third input signal and respectively provide the first output signal, the second output signal, the third output signal, and the fourth output signal to the first color pixel, the second color pixel, the third color pixel, and the fourth color pixel for displaying images. It is noted that the signal value of the first input signal is zero, and the signal value of the fourth output signal is not zero.

For example, if the first, second, and third input signals are respectively the red, green, and blue image input signals, the first, second, third, and fourth output signals are respectively the red, green, blue, and white (or transparent) image output signals. When the signal value of any of the red, green, and blue image input signal is zero, the signal value of the white image output signal is not zero. In addition, when another color frame is displayed, the signal values of two colors in the three-color image are zero. For example, the signal values of the red and green images are zero, the signal values of the red and blue image are zero, or the signal values of the blue and green image are zero. However, the signal value of the white image control signal is not zero.

As a result, the fourth output signal can be used to compensate for the first, second, and third output signals so as to prolong the operational life of the first, second, third, and fourth color pixels of a unit pixel.

Another aspect of the present disclosure is to provide a control method of displaying an image with a display device, wherein a display panel includes a first color pixel, second color pixel, third color pixel, and fourth color pixel. The control method includes receiving a first input signal, second input signal, and third input signal by the data processing unit, wherein the signal value of the first input signal is zero.

Subsequently, the first output signal, second output signal and third output signal are respectively generated according to transformation factors of each of the first input signal, second input signal, and third input signal. The transformation factor herein is similar to the decrement offset as described above. Thereafter, the fourth output signal is generated according to a brightness enhancement factor. The brightness enhancement factor herein is similar to the compensation value as described above. Furthermore, the first output signal, second output signal, third output signal, and fourth output signal are respectively outputted to the first color pixel, second color pixel, third color pixel, and fourth color pixel by the data processing unit for displaying an image. It is noted that the signal value of the fourth output signal is not zero.

Equally, if the first, second, and third input signals are respectively the red, green, and blue image input signals, the first, second, third, and fourth output signal are respectively the red, green, blue, and white image output signals. When the signal value of any of the red, green, and blue image input signal is zero, the signal value of the white image output signal is not zero. In addition, when another color frame is displayed, the signal values of two colors in the three-color image are zero. For example, the signal values of the red and green images are zero, the signal values of the red and blue image are zero, or the signal values of the blue and green image are zero. However, the signal value of the white image control signal is not zero.

As a result, the fourth output signal generated according to the brightness enhancement factor can be used to compensate for the first, second, and third output signal, each of which is generated according to the transformation factor, so as to prolong the operational life of the first, second, third, and fourth color pixel of a unit pixel.

In addition, those skilled in the art will appreciate that each of the steps of the control method for displaying an image with a display device named after the function thereof is merely used to describe the technology in the embodiment of the present invention in detail, but the method is not limited in this regard. Therefore, combining the steps of said method into one step, dividing the steps into several steps, or rearranging the order of the steps is within the scope of the embodiment in the present invention.

In view of the above embodiments of the present disclosure, it is apparent that the application of the present disclosure has a number of advantages. Embodiments of the present disclosure provide a display device and a control method for displaying an image with a display device so as to prolong the operational life of a red sub-pixel and a blue sub-pixel of a unit pixel which can only contain three sub-pixels.

It will be apparent to those skilled in the art that various modifications and variations can be made to the structure of the present disclosure without departing from the scope or spirit of the invention. In view of the foregoing, it is intended that the present disclosure cover modifications and variations of this invention provided they fall within the scope of the following claims.

What is claimed is:

1. A display device, comprising:

a red sub-pixel;

a green sub-pixel;

a blue sub-pixel;

a white sub-pixel;

a color transformer receiving and transforming a three-color image into a four-color image, wherein the four-color image comprises a red image, a green image, a blue image and a white image; and an image controller calculating a decrement offset of the red image, a decrement offset of the green image, a decrement offset of the blue image and a compensation value of the white image;

wherein when a value of the white image is zero, the image controller calculates a gray level value of the red image, a gray level value of the green image, and a gray level value of the blue image, the image controller respectively calculates a red image control signal for the red sub-pixel, a green image control signal for the green sub-pixel and a blue image control signal for the blue sub pixel according to the gray level values and the decrement offsets, and the image controller calculates a white image control signal for the white sub-pixel according to the gray level values and the compensation value of the white image;

wherein the display device displays an image by controlling the red sub-pixel according to the red image control signal, controlling the green sub-pixel according to the green image control signal, controlling the blue sub-pixel according to the blue image control signal, and controlling the white sub pixel according to the white image control signal; and wherein one of the three-color image is zero and a signal value of the white image control signal is not zero.

2. The display device according to claim 1, wherein the image controller measures a smallest chromaticity area of the display device, and respectively calculates the decrement offset of the red image, the decrement offset of the green image, the decrement offset of the blue image and the compensation value of the white image according to the smallest chromaticity area.

3. The display device according to claim 1, further comprising:

an average value calculator respectively calculating an average value of the red image, an average value of the green image and an average value of the blue image, and transmitting the average values to the image controller;

wherein the image controller respectively calculates the red image control signal, the green image control signal and the blue image control signal according to the gray level values, the decrement offsets and the average values, and calculates the white image control signal according to the gray level values, the average values and the compensation value of the white image.

4. The display device according to claim 3, wherein the image controller respectively calculates the red image control signal, the green image control signal, the blue image control signal and the white image control signal according to the following formulas:

$$\begin{cases} R_o = R_s - dR \times R_s/(2^n-1) \times R_{avg}/(2^n-1) \\ G_o = G_s - dG \times G_s/(2^n-1) \times G_{avg}/(2^n-1) \\ B_o = B_s - dB \times B_s/(2^n-1) \times B_{avg}/(2^n-1) \\ W_o = W_s + dW_r \times R_s/(2^n-1) \times R_{avg}/ \\ (2^n-1) + dW_g \times G_s/(2^n-1) \times G_{avg}/(2^n-1) + \\ dW_b \times B_s/(2^n-1) \times B_{avg}/(2^n-1) \end{cases}$$

where $R_o$, $G_o$, $B_o$, $W_o$ are the red image control signal, the green image control signal, the blue image control signal and the white image control signal respectively, $R_s$, $G_s$, $B_s$, $W_s$ are the gray level value of the red image, the gray level value of the green image, the gray level value of the blue image and the gray level value of the white image respectively, dR, dG, dB are the decrement offset of the red image, the decrement offset of the green image and the decrement offset of the blue image respectively, and $R_{avg}$, $G_{avg}$, $B_{avg}$ are the average value of the red image, the average value of the green image and the average value of the blue image respectively, wherein the compensation value of the white image comprises a compensation value of the white image against the red image $dW_r$, a compensation value of the white image against the green image $dW_g$ and a compensation value of the white image against the blue image $dW_b$, wherein n is a positive integer.

5. The display device according to claim 1, further comprising:

a light detector detecting an external environmental light source to generate and transmit a light detection signal to the image controller;

wherein the image controller respectively calculates the red image control signal, the green image control signal and the blue image control signal according to the gray level values, the decrement offsets and the light detection signal, and calculates the white image control signal according to the gray level values, the light detection signal and the compensation value of the white image.

6. The display device according to claim 5, wherein the image controller calculates the red image control signal, the green image control signal, the blue image control signal and the white image control signal according to the following formulas:

$$\begin{cases} R_o = R_s - dR \times R_s/(2^n-1) \times E_v/(2^n-1) \\ G_o = G_s - dG \times G_s/(2^n-1) \times E_v/(2^n-1) \\ B_o = B_s - dB \times B_s/(2^n-1) \times E_v/(2^n-1) \\ W_o = W_s + dW_r \times R_s/(2^n-1) \times E_v/ \\ (2^n-1) + dW_g \times G_s/(2^n-1) \times E_v/(2^n-1) + \\ dW_b \times B_s/(2^n-1) \times E_v/(2^n-1) \end{cases}$$

where $R_o$, $G_o$, $B_o$, $W_o$ are the red image control signal, the green image control signal, the blue image control signal and the white image control signal respectively, $R_s$, $G_s$, $B_s$, $W_s$ are the gray level value of the red image, the gray level value of the green image, the gray level value of the blue image and the gray level value of the white image respectively, dR, dG, dB are the decrement offset of the red image, the decrement offset of the green image and the decrement offset of the blue image respectively, and Ev is the light detection signal, wherein the compensation value of the white image comprises a compensation value of the white image against the red image $dW_r$, a compensation value of the white image against the green image $dW_g$ and a compensation value of the white image against the blue image $dW_b$, wherein n is a positive integer.

7. The display device according to claim 1, further comprising:

an image edge detector respectively detecting an image edge of the red image, an image edge of the green image and an image edge of the blue image, and transmitting the image edges to the image controller;

wherein the image controller respectively calculates the red image control signal, the green image control signal and the blue image control signal according to the gray level values, the decrement offsets and the image edges, and calculates the white image control signal according to the gray level values, the image edges and the compensation value of the white image.

8. The display device according to claim 7, wherein the image controller calculates the red image control signal, the green image control signal, the blue image control signal and the white image control signal according to the following formulas:

$$\begin{cases} R_o = R_s - dR \times R_s/(2^n-1) \times R_{edge}(x, y)/(2^n-1) \\ G_o = G_s - dG \times G_s/(2^n-1) \times G_{edge}(x, y)/(2^n-1) \\ B_o = B_s - dB \times B_s/(2^n-1) \times B_{edge}(x, y)/(2^n-1) \\ W_o = W_s + dW_r \times R_s/(2^n-1) \times R_{edge}(x, y)/(2^n-1) + \\ dW_g \times G_s/(2^n-1) \times G_{edge}(x, y)/(2^n-1) + \\ dW_b \times B_s/(2^n-1) \times B_{edge}(x, y)/(2^n-1) \end{cases}$$

where $R_o$, $G_o$, $B_o$, $W_o$ are the red image control signal, the green image control signal, the blue image control signal and the white image control signal respectively, $R_s$, $G_s$, $B_s$, $W_s$ are the gray level value of the red image, the gray level value of the green image, the gray level value of the blue image and the gray level value of the white image respectively, dR, dG, dB are the decrement offset of the red image, the decrement offset of the green image and the decrement offset of the blue image respectively, and $R_{edge}$, $G_{edge}$, $B_{edge}$ are the image edge of the red image, the image edge of the green image and the image edge of the blue image respectively, wherein the compensation value of the white image comprises a compensation value of the white image against the red image $dW_r$, a compensation value of the white image against the green image $dW_g$ and a compensation value of the white image against the blue image $dW_b$, wherein n is a positive integer.

9. The display device according to claim 1, wherein the compensation value of the white image compensates for the decrement offset of the red image, the decrement offset of the green image, and the decrement offset of the blue image.

10. A control method for a display device, wherein the display device comprises a red sub-pixel, a green sub-pixel, a blue sub-pixel and a white sub-pixel, wherein the control method comprises:

receiving and transforming a three-color image into a four-color image, wherein the four-color image comprises a red image, a green image, a blue image and a white image;

calculating a decrement offset of the red image, a decrement offset of the green image, a decrement offset of blue image and a compensation value of the white image;

when a value of the white image is zero, calculating a gray level value of the red image, a gray level value of the green image, and a gray level value of the blue image;

calculating a red image control signal for the red sub-pixel, a green image control signal for the green sub-pixel and a blue image control signal for the blue sub pixel according to the gray level values and the decrement offsets;

calculating a white image control signal for the white sub-pixel according to the gray level values and the compensation value of the white image, wherein one of the three-color image is zero and a signal value of the white image control signal is not zero; and controlling the display device to display an image by controlling the red sub pixel according to the red image control signal, controlling the green sub-pixel according to the green image control signal, controlling the blue sub-pixel according to the blue image control signal, and controlling the white sub-pixel according to the white image control signal.

11. The control method according to claim 10, further comprising:

measuring a smallest chromaticity area of the display device;

wherein calculating the decrement offset of the red image, the decrement offset of the green image, the decrement offset of blue image and the compensation value of the white image comprises:

respectively calculating the decrement offset of the red image, the decrement offset of the green image, the decrement offset of the blue image and the compensation value of the white image according to the smallest chromaticity area.

12. The control method according to claim 10, further comprising:

respectively calculating an average value of the red image, an average value of the green image and an average value of the blue image;

respectively calculating the red image control signal, the green image control signal and the blue image control signal according to the gray level values, the decrement offsets and the average values; and calculating the white image control signal according to the gray level values, the average values and the compensation value of the white image.

13. The control method according to claim 12, wherein respectively calculating the red image control signal, the green image control signal and the blue image control signal according to the gray level values, the decrement offsets and the average values and calculating the white image control signal according to the gray level values, the average values and the compensation value of the white image are calculated by the following formulas:

$$\begin{cases} R_o = R_s - dR \times R_s/(2^n-1) \times R_{avg}/(2^n-1) \\ G_o = G_s - dG \times G_s/(2^n-1) \times G_{avg}/(2^n-1) \\ B_o = B_s - dB \times B_s/(2^n-1) \times B_{avg}/(2^n-1) \\ W_o = W_s + dW_r \times R_s/(2^n-1) \times R_{avg}/ \\ (2^n-1) + dW_g \times G_s/(2^n-1) \times G_{avg}/(2^n-1) + \\ dW_b \times B_s/(2^n-1) \times B_{avg}/(2^n-1) \end{cases}$$

where $R_o$, $G_o$, $B_o$, $W_o$ are the red image control signal, the green image control signal, the blue image control signal and the white image control signal respectively, $R_s$, $G_s$, $B_s$, $W_s$ are the gray level value of the red image, the gray level value of the green image, the gray level value of the blue image and the gray level value of the white image respectively, dR, dG, dB are the decrement offset of the red image, the decrement offset of the green image and the decrement offset of the blue image respectively, and $R_{avg}$, $G_{avg}$, $B_{avg}$ are the average value of the red image, the average value of the green image and the average value of the blue image respectively, wherein the compensation value of the white image comprises a compensation value of the white image against the red image $dW_r$, a compensation value of the white image against the green image $dW_g$ and a compensation value of the white image against the blue image $dW_b$, wherein n is a positive integer.

14. The control method according to claim 10, further comprising:

detecting an external environmental light source to generate a light detection signal;

respectively calculating the red image control signal, the green image control signal and the blue image control signal according to the gray level values, the decrement offsets and the light detection signal; and calculating the white image control signal according to the gray level values, the light detection signal and the compensation value of the white image.

15. The control method according to claim 14, wherein respectively calculating the red image control signal, the green image control signal and the blue image control signal according to the gray level values, the decrement offsets and the light detection signal and calculating the white image control signal according to the gray level values, the light detection signal and the compensation value of the white image are calculated by the following formulas:

$$\begin{cases} R_o = R_s - dR \times R_s / (2^n - 1) \times E_v / (2^n - 1) \\ G_o = G_s - dG \times G_s / (2^n - 1) \times E_v / (2^n - 1) \\ B_o = B_s - dB \times B_s / (2^n - 1) \times E_v / (2^n - 1) \\ W_o = W_s + dW_r \times R_s / (2^n - 1) \times E_v / \\ (2^n - 1) + dW_g \times G_s / (2^n - 1) \times E_v / (2^n - 1) + \\ dW_b \times B_s / (2^n - 1) \times E_v / (2^n - 1) \end{cases}$$

where $R_o$, $G_o$, $B_o$, $W_o$ are the red image control signal, the green image control signal, the blue image control signal and the white image control signal respectively, $R_s$, $G_s$, $B_s$, $W_s$ are the gray level value of the red image, the gray level value of the green image, the gray level value of the blue image and the gray level value of the white image respectively, dR, dG, dB are the decrement offset of the red image, the decrement offset of the green image and the decrement offset of the blue image respectively, and Ev is the light detection signal, wherein the compensation value of the white image comprises a compensation value of the white image against the red image $dW_r$, a compensation value of the white image against the green image $dW_g$ and a compensation value of the white image against the blue image $dW_b$, wherein n is a positive integer.

16. The control method according to claim 10, further comprising:

respectively detecting an image edge of the red image, an image edge of the green image and an image edge of the blue image;

respectively calculating the red image control signal, the green image control signal and the blue image control signal according to the gray level values, the decrement offsets and the image edges; and calculating the white image control signal according to the gray level values, the image edges and the compensation value of the white image.

17. The control method according to claim 16, wherein respectively calculating the red image control signal, the green image control signal and the blue image control signal according to the gray level values, the decrement offsets and the image edges; and calculating the white image control signal according to the gray level values, the image edges and the compensation value of the white image are calculated by the following formulas:

$$\begin{cases} R_o = R_s - dR \times R_s / (2^n - 1) \times R_{edge}(x, y) / (2^n - 1) \\ G_o = G_s - dG \times G_s / (2^n - 1) \times G_{edge}(x, y) / (2^n - 1) \\ B_o = B_s - dB \times B_s / (2^n - 1) \times B_{edge}(x, y) / (2^n - 1) \\ W_o = W_s + dW_r \times R_s / (2^n - 1) \times R_{edge}(x, y) / (2^n - 1) + \\ dW_g \times G_s / (2^n - 1) \times G_{edge}(x, y) / (2^n - 1) + \\ dW_b \times B_s / (2^n - 1) \times B_{edge}(x, y) / (2^n - 1) \end{cases}$$

where $R_o$, $G_o$, $B_o$, $W_o$ are the red image control signal, the green image control signal, the blue image control signal and the white image control signal respectively, $R_s$, $G_s$, $B_s$, $W_s$ are the gray level value of the red image, the gray level value of the green image, the gray level value of the blue image and the gray level value of the white image respectively, dR, dG, dB are the decrement offset of the red image, the decrement offset of the green image and the decrement offset of the blue image respectively, and $R_{edge}$, $G_{edge}$, $B_{edge}$ are the image edge of the red image, the image edge of the green image and the image edge of the blue image respectively, wherein the compensation value of the white image comprises a compensation value of the white image against the red image $dW_r$, a compensation value of the white image against the green image $dW_g$ and a compensation value of the white image against the blue image $dW_b$, wherein n is a positive integer.

* * * * *